US007642979B2

(12) United States Patent
Höök et al.

(10) Patent No.: US 7,642,979 B2
(45) Date of Patent: Jan. 5, 2010

(54) WAVE-GUIDE-NOTCH ANTENNA

(75) Inventors: Anders Höök, Hindås (SE); Jessica Westerberg, Göteborg (SE); Joakim Johansson, Töllsjö (SE)

(73) Assignee: Telefonaktiebolaget L M (publ), Stockholm (SE)

( * ) Notice: Subject to any disclaimer, the term of this patent is extended or adjusted under 35 U.S.C. 154(b) by 193 days.

(21) Appl. No.: 11/573,828

(22) PCT Filed: Aug. 18, 2004

(86) PCT No.: PCT/SE2004/001207

§ 371 (c)(1), (2), (4) Date: Jul. 30, 2007

(87) PCT Pub. No.: WO2006/019339

PCT Pub. Date: Feb. 23, 2006

(65) Prior Publication Data

US 2007/0296639 A1 Dec. 27, 2007

(51) Int. Cl.
*H01Q 13/10* (2006.01)

(52) U.S. Cl. ..... 343/767; 343/771

(58) Field of Classification Search ..... 343/767, 343/770, 772, 768, 771
See application file for complete search history.

(56) References Cited

U.S. PATENT DOCUMENTS

| | | | | |
|---|---|---|---|---|
| 5,227,808 | A * | 7/1993 | Davis | 343/915 |
| 6,133,888 | A | 10/2000 | Mohuchy | |
| 6,552,691 | B2 | 4/2003 | Mohuchy | |
| 6,577,207 | B2 | 6/2003 | Volman | |
| 6,842,154 | B1 * | 1/2005 | Apostolos | 343/767 |
| 2004/0004580 | A1 | 1/2004 | Toland | |

FOREIGN PATENT DOCUMENTS

EP 0831550 A1 3/1998

* cited by examiner

*Primary Examiner*—Shih-Chao Chen
(74) *Attorney, Agent, or Firm*—Roger Burleigh

(57) ABSTRACT

A dual polarized wave-guide notch antenna array is disclosed. The device comprises a feed section having at least two input transmission lines, a feed/wave-guide interface providing an aperture for transferring a radio frequency electromagnetic wave between the feed section and a wave-guide mode in a wave-guide section having ridges. The wave-guide section transfers energy between the feed/wave-guide interface and a tapered notch section, thereby gradually adjusting a created electromagnetic field towards free space conditions.

12 Claims, 4 Drawing Sheets

WAVE-GUIDE-NOTCH ANTENNA

TECHNICAL FIELD

The present invention relates to a wave-guide-notch antenna and more particularly a dually polarised wave-guide-notch antenna.

BACKGROUND

When designing electrically steerable antennas (ESA) one strives for at least some of the following properties: low-weight, broad-band, dual polarisation, low losses, wide coverage, adequate packaging and a construction simple to manufacture as well as at low cost.

Balanced antenna elements such as the radiating portion of a notch element possesses excellent bandwidth properties, but are cumbersome to realise, e.g. to manufacture. One reason for this is that at least one transmission line per element needs to cross the ground plane, implying a feed through and possibly a contact.

The situation becomes even more complex when the possibility to switch between different polarisation states (e.g. linear and circular) is required.

A convenient way of feeding antenna elements above a ground plane is excitation by means of slots in the ground plane. This removes the need for a feed through or a contact If wave-guide elements are to be tightly packaged and slot-fed with satisfactory results, see FIG. 1, they usually require electrically dense dielectrics in the wave-guide. However, such dielectrics tend to be far too heavy to be considered for use in large array antennas. As an alternative, protruding wave-guide ridges, with the ridge height gradually reduced towards the free-space end (in order to get good matching towards free-space) can be used. However there are doubts that high performance notch elements can be slot-fed because of seemingly disparate transverse field distributions.

Efficient antenna element design requires that the element volume be split at well-defined interfaces into several smaller volumes that can be optimised at a significantly lesser effort. However, a split interface in a protruding ridge/notch region of the antenna element implies boundary conditions not implemented in EM analysis software of today. On the other hand, a split interface in a wave-guide can be simulated with high accuracy.

Standard ridged wave-guide feeds do not easily fit into standard lowcost industrial manufacturing methods, while probe or stripline fed slots do, as doses a probe fed ridge.

A U.S. Pat. No. 6,577,207 from Jun. 10, 2003 discloses a dual-band electromagnetic coupler, which uses a ridged square wave-guide section to couple a square port of a mode converter to a common square port. The ridged square wave-guide section includes ridges and phase shifters which delay components of the high-band modes to produce a $TE_{1,0}$ and a $TE_{0,1}$ mode at the common port in both bands.

Another U.S. Pat. No. 6,552,691 from Apr. 22, 2003 discloses a broadband dual polarised micro-strip notch antenna. The phased array antennas includes two planar micro-strip notch elements that interlock and are perpendicular to each other having their phase centres coincident providing advantageous operational characteristics for forming wide bandwidth and wide scan angle.

Still another European patent EP0831550 discloses an antenna element consisting of a micro-strip section mounted at right angles to a support leaving a gap between the micro-strip section and the edge of the support. A notch starts from the free micro-strip edge. This has a wide section narrowing to a second narrower section. The notch dimensions provide a fixed phase centre in a narrow band of around 10% of desired centre frequency.

However these documents are considered to only constitute the state of the art and in any way not anticipating the present application.

Therefore there is still a wish to in a simple way obtain the properties desired to simultaneously achieve the requirements mentioned above and a solution for such a dually polarised wave-guide-notch antenna is here suggested by the present invention.

SUMMARY OF THE INVENTION

A dual polarised wave-guide notch antenna array is disclosed. The device comprises of a feed section, consisting of either strip-line transmission lines or longitudinally oriented probes, a feed/wave-guide interface that enables controlled energy transfer between the feed section and the wave-guide section, a wave-guide section with ridges, transferring energy between the interface and a tapered notch-section, in which the electromagnetic field is gradually adjusted towards free-space conditions.

The device is set forth by the independent claim 1 and further embodiments are set forth by the dependent claims 2 to 6.

DESCRIPTION OF THE DRAWINGS

The invention, together with further objects and advantages thereof, may be best understood by making reference to the following description taken together with the accompanying drawings, in which.

DETAILED DESCRIPTION

Figure 1:
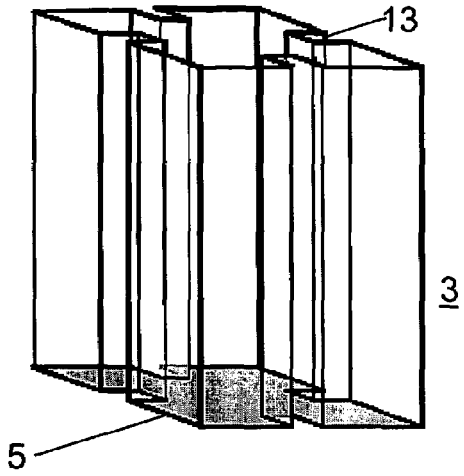
FIG. 1 illustrates the interior boundary surface of a ridged wave-guide antenna element from which bottom the ridged wave-guide may be fed by an aperture, i.e. the feed wave-guide interface.
Figure 2:
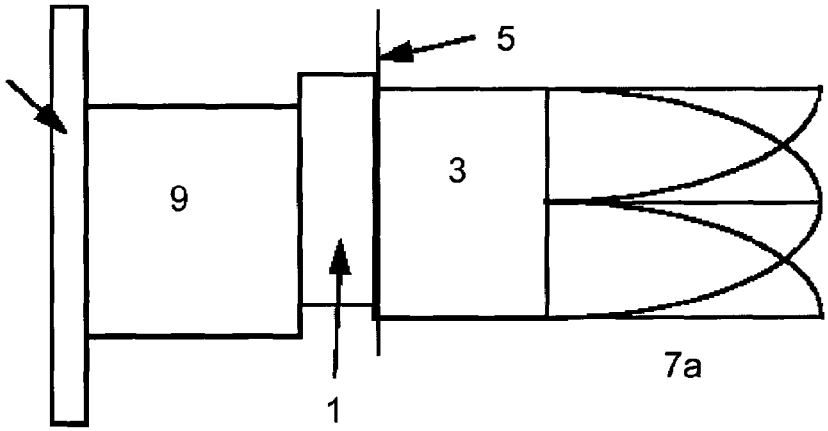
FIG. 2 illustrates main sections in accordance with the present invention.

An embodiment of the invention consists of a feed section 1 constituting a strip-line section or a probe section, where two (or more) input transmission lines 2 and/or probes 6 are arranged so that e.g. one linear and one circular polarization is transmitted (or received) depending on how the input transmission lines 2 are excited. The feed section 1 transfers the strip-line wave or the probe wave to a wave-guide mode (and vice versa), of a ridged wave-guide section 3, a feed/wave-guide interface 5, e.g. in the form of crossed slots. The wave-guide mode finally enters the tapered notch section 7, which due to its TEM character gradually adjusts the field towards free-space conditions ($Z_0 \approx 377$ ohms) outside the antenna. (Also see FIG. 2, FIG. 3*a* and FIG. 3*b*).

Thus, a feed section 1 may consist of a strip-line section with at least one hybrid feeding the crossed-slot feed/wave-guide interface 5 aperture. In another embodiment the feed section is realized using longitudinal probes 6 feeding a general feed/wave-guide interface 5 aperture, including crossed-slot apertures. Still an underlying strip-line section may feed the longitudinal probes.

The ridged hollow wave-guide section 3 may be of arbitrary length and it may also conceptually be omitted and replaced only by a wave-guide like the ridged wave-guide section 7*a*. The wave-guide section 3 is generally realized with adjoining wave-guide walls, thus creating a self-supporting wave-guide or can be made with isolated wall segments that need to be assembled individually, or using no wave-guide walls at all, but only presenting the tapered ridges 13.

The feed section 1 with or without a probe section is positioned underneath the wave-guide section 3. The probe section can have an underlying strip line section that may constitute one or more hybrids and the output of the feed section is generally two signals, either in phase (linear polarization) or in quadrature (circular polarization). This functionality may also be included in a T/R module 9.

If needed, the T/R module 9 and the feed section 1 or the probe section may be displaced relative to the slot layer and wave-guide section 3.

Figure 3A:
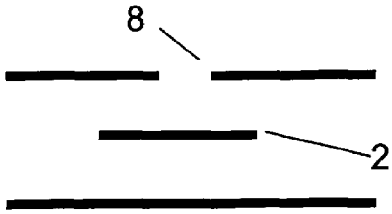
FIG. 3*a* illustrates a strip-line section containing a slot.
Figure 3B:
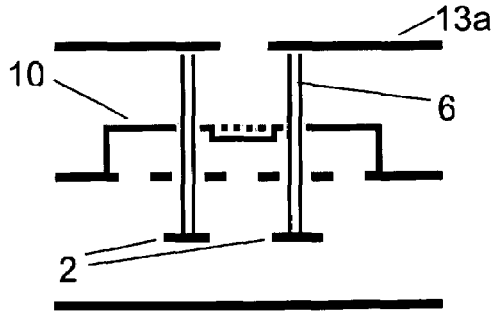
FIG. 3*b* illustrates a probe section with an underlying strip-line section.

FIG. 3*a* illustrates schematically seen from the side a feed section constituting a strip-line section feeding a slot 8 and FIG. 3*b* illustrates seen from the side another feed section comprising a strip-line section and two probes 6 feeding bottom ends of respective notch section pair 13*a* by a capacitive or inductive coupling or a combination thereof. Reference number 10 indicates an optional protrusion in the feed section.

Figure 4:
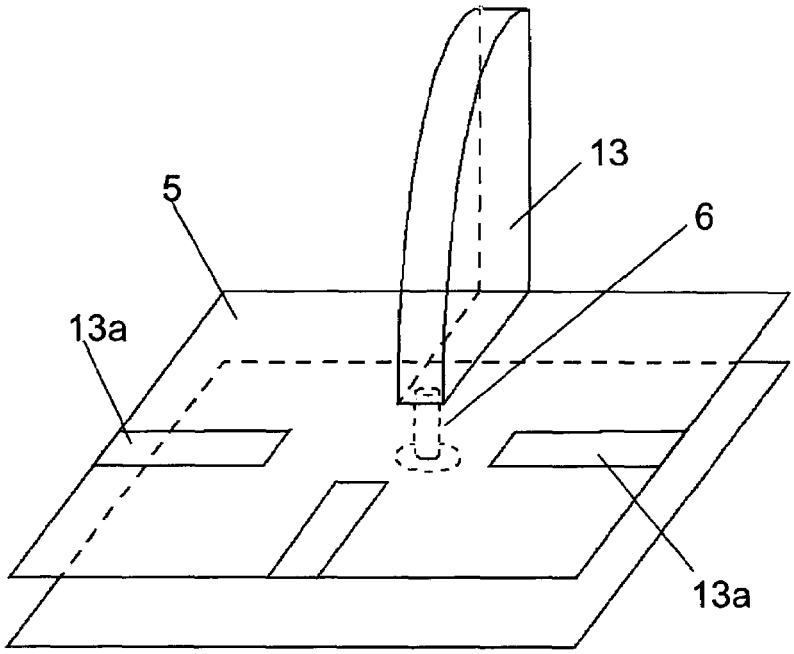
FIG. 4 illustrates a part of a feed section using a probe for feeding a shown tapered ridge section.
Figure 5:
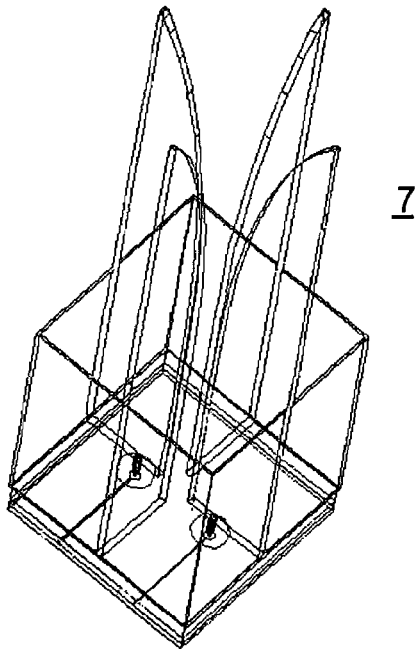
FIG. 5 illustrates in a three-dimensional view four tapered ridges with one pair being fed by probes for obtaining a first polarisation.

FIG. 4 illustrates in more detail a feeding of a notch section 13 by a probe 6 from an underlying strip-line section (not shown in FIG. 4). FIG. 5 illustrates in a three-dimensional view the wave-guide section 3 with the two pairs of tapered ridges 13 for either linear or circular polarization. The probes typically are electro-magnetically coupled to the bottom surfaces 13*a* of the tapered ridges.

Figure 6:
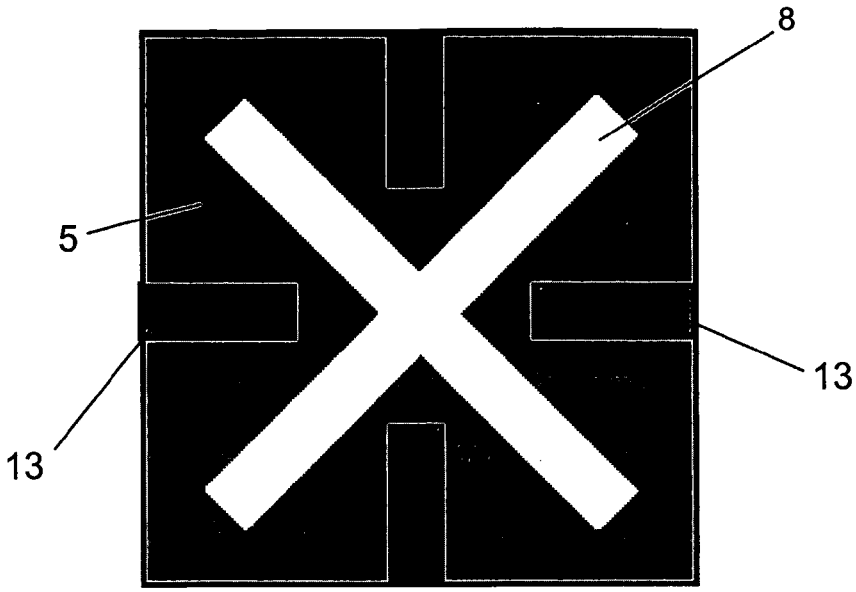
FIG. 6 illustrates a crossed-slot layer.

In FIG. 6 the feed/wave-guide interface 5 in the shape of a crossed slot 8 is depicted. The footprints of the ridges 13 are shown. It is important that neither the slots, nor the ridge cross sections need to be rectangular. For matching reasons the slot width may vary along the length of the slot 8, and the ridge cross section may have a form that more closely follows the edges of the slots.

Figure 7:
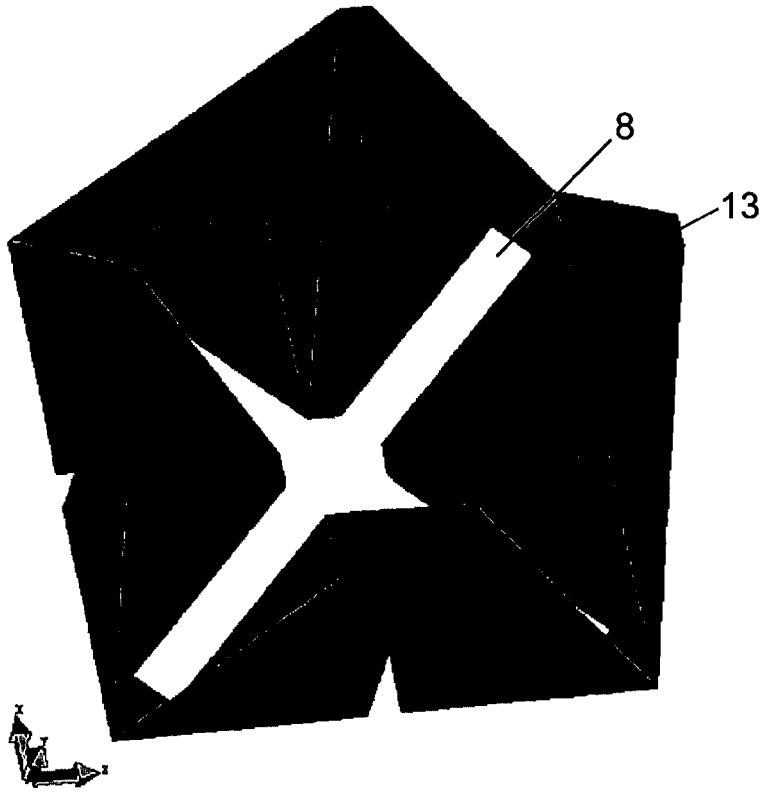
FIG. 7 illustrates a tapered section fed by a crossed slot.

In FIG. 7 and as a further example, the walls of the wave-guide 3 have been tapered all the way down to the slot 8. Consequently the tapered notch section starts at this layer with no intermediate ridged wave-guide section. Moreover the taper function in FIG. 7 is linear, while a more convenient choice could for instance show an exponential shape as indicated in FIG. 5.

Figure 8:
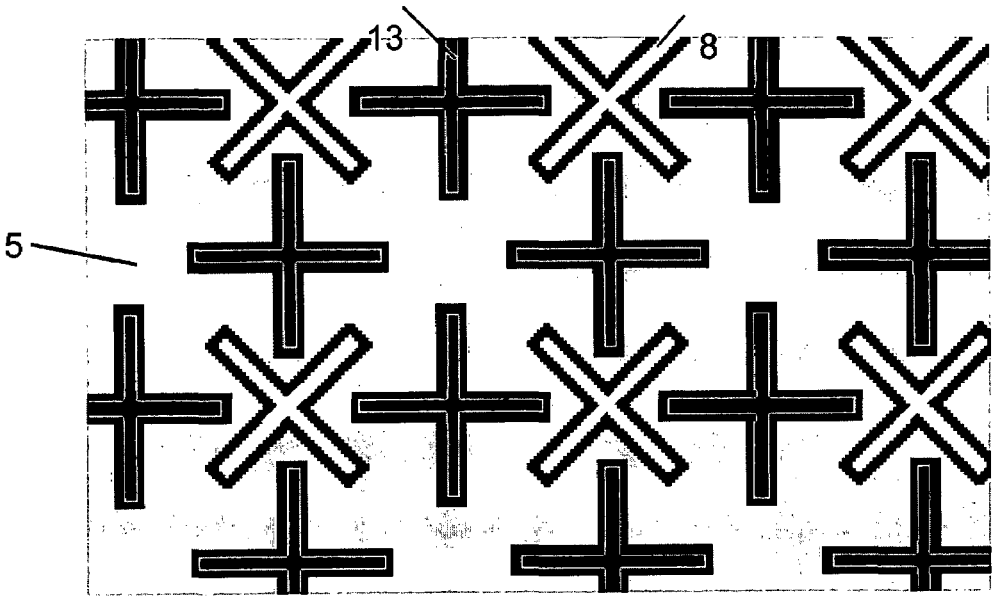
FIG. 8 illustrates characteristic footprints of slots (slanted crosses) and ridge/walls (standing crosses)

As an example of the zero length wave-guide section the footprints of the ridges and tapered wave-guide walls are depicted in FIG. 8. Clearly, the footprints of the walls can be chosen to be equal in shape to the footprints of the ridges 13, creating symmetric crosses when creating an antenna array.

Figure 9:
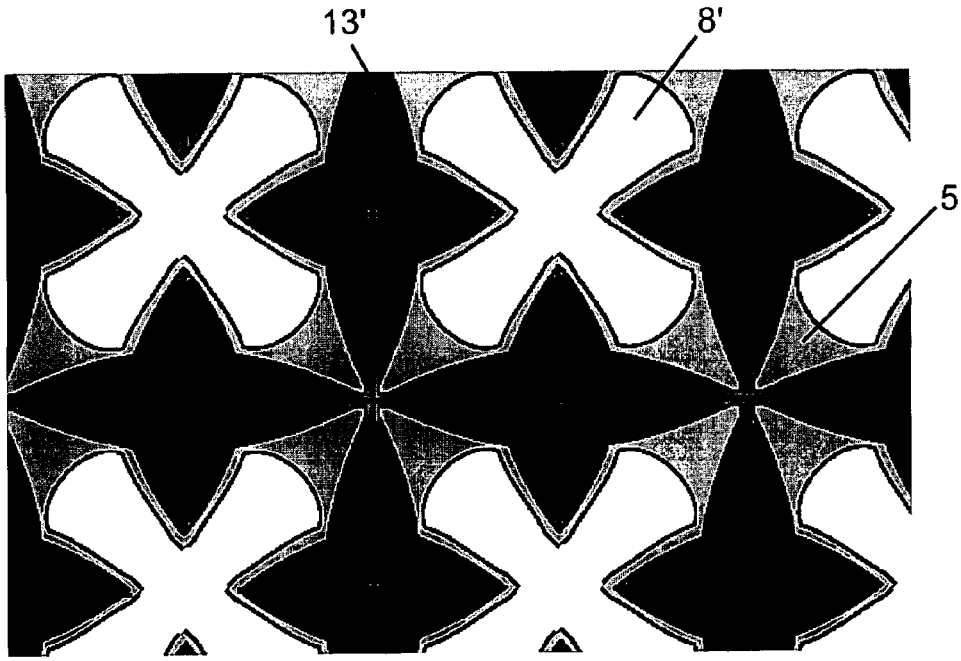
FIG. 9 shows footprints of slots (white) wall/ridges (dark grey) on the wave-guide bottom (light grey).

FIG. 9 illustrates a configuration with optional crossed slots 8' and tapered ridges 13' having optional shapes with varying widths.

ADVANTAGES OF THE PRESENT INVENTION

The present invention designates convenient feeding techniques (strip-line fed slots, probe-fed slots or, more generally a probe-fed aperture in the feed/wave-guide interface) to a doubly polarised and broadband radiating aperture consisting of an optional wave-guide section and a tapered notch section. The presence of a wave-guide section facilitates analysis as well as it offers the possibility of a self-supporting radiating element grid. Such a grid offers small, manufacturing-originated tolerances, rather than high, assembly-originated tolerances. In particular no probes through the ground plane (wave-guide bottom) are needed, facilitating a simple mount technique of an electrically high performance scanned antenna array (ESA).

It will be understood by those skilled in the art that various modifications and changes could be made to the present invention without departure from the spirit and scope thereof, which is defined by the appended claims.

The invention claimed is:

1. A dual polarized wave-guide notch microwave antenna array, comprising:

a feed section with at least two input transmission lines each connecting to a pair of feed elements, wherein the feed section provides crossed slots or probes for transferring at least one wave signal into a wave-guide mode;

a wave-guide section;

a tapered notch section; and a feed/wave-guide interface with a general aperture shape allowing energy transfer between the feed section and the wave-guide section, wherein the wave-guide section has ridges and transfers energy between the feed/wave-guide interface and the tapered notch section, wherein the tapered notch section gradually adjusts a ridged wave-guide electromagnetic field mode towards free-space conditions.

2. The antenna array according to claim 1, wherein the feed section comprises strip-line transmission lines feeding a crossed-slot feed/wave-guide interface aperture.

3. The antenna array according to claim 2, wherein the wave-guide section comprises adjoining wave-guide walls needing a self-supporting wave-guide grid.

4. The antenna array according to claim 2, wherein the wave-guide section comprises isolated wall segments which need to be assembled individually.

5. The antenna array according to claim 2, wherein the wave-guide section comprises no wave-guide walls at all.

6. The antenna array according to claim 2, wherein the geometry of the crossed-slot feed/wave-guide interface aperture and notches in the tapered notch section are adjusted to a shape matching an expected notch-supported field.

7. The antenna array according to claim 1, wherein the feed section comprises longitudinal probes feeding a general feed/wave-guide interface aperture, including crossed-slot apertures.

8. The antenna array according to claim 7, wherein the wave-guide section comprises adjoining wave-guide walls facilitating a self-supporting wave-guide grid.

9. The antenna array according to claim 7, wherein the wave-guide section comprises isolated wall segments which need to be assembled individually.

10. The antenna array according to claim 7, wherein the wave-guide section comprises no wave-guide walls at all.

11. The antenna array according to claim 1, wherein the feed section comprises at least one hybrid which outputs microwave signals being either in phase or in quadrature.

12. The antenna array according to claim 1, wherein footprints of the ridges of the wave-guide section are chosen equal to the footprints of crossed-slots.

* * * * *

UNITED STATES PATENT AND TRADEMARK OFFICE

CERTIFICATE OF CORRECTION

PATENT NO. : 7,642,979 B2
APPLICATION NO. : 11/573828
DATED : January 5, 2010
INVENTOR(S) : Hook et al.

It is certified that error appears in the above-identified patent and that said Letters Patent is hereby corrected as shown below:

On the Cover Page, item (73), under "Assignee", in Column 1, Line 1, after "L M" insert -- Ericsson --.

Signed and Sealed this

Twenty-seventh Day of April, 2010

David J. Kappos

David J. Kappos
*Director of the United States Patent and Trademark Office*